US006855240B2

(12) United States Patent
Cooper et al.

(10) Patent No.: US 6,855,240 B2
(45) Date of Patent: Feb. 15, 2005

(54) COFE ALLOY FILM AND PROCESS OF MAKING SAME

(75) Inventors: Emanuel Israel Cooper, Scarsdale, NY (US); Thomas Edward Dinan, San Jose, CA (US); Lubomyr Taras Romankiw, New York, NY (US); Hong Xu, Albany, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 8 days.

(21) Appl. No.: 10/457,194

(22) Filed: Jun. 9, 2003

(65) Prior Publication Data

US 2003/0209295 A1 Nov. 13, 2003

Related U.S. Application Data

(62) Division of application No. 09/634,171, filed on Aug. 9, 2000.

(51) Int. Cl.[7] ..... D25D 3/56

(52) U.S. Cl. ..... 205/103; 205/104; 205/259; 205/260

(58) Field of Search ..... 205/103, 104, 205/259, 260

(56) References Cited

U.S. PATENT DOCUMENTS

| | | | | |
|---|---|---|---|---|
| 2,654,703 A | | 10/1953 | Brown | |
| 4,014,759 A | | 3/1977 | McMullen et al. | |
| 4,053,373 A | | 10/1977 | McMullen et al. | |
| 4,208,254 A | | 6/1980 | Mitsumoto et al. | |
| 4,306,908 A | | 12/1981 | Takayama et al. | |
| 4,430,171 A | * | 2/1984 | Lemke et al. | 205/260 |
| 4,756,816 A | | 7/1988 | Liao et al. | |
| 4,925,502 A | | 5/1990 | Yamagishi et al. | |
| 4,933,026 A | | 6/1990 | Rawlings et al | |
| 5,372,698 A | | 12/1994 | Liao | |
| 5,582,927 A | | 12/1996 | Andricacos et al. . | |
| 5,587,026 A | | 12/1996 | Iwasaki et al. | |
| 5,741,374 A | | 4/1998 | Li | 148/319 |
| 5,817,191 A | | 10/1998 | Emmerich et al. | 148/311 |
| 5,919,319 A | | 7/1999 | Couderchon | 148/311 |
| 6,146,474 A | | 11/2000 | Coutu et al. | 148/325 |

FOREIGN PATENT DOCUMENTS

| | | |
|---|---|---|
| JP | 2107737 A2 | 4/1990 |
| JP | 4229607 A2 | 8/1992 |
| JP | 6036929 A2 | 2/1994 |

OTHER PUBLICATIONS

Kakuno et al, "Structure, Composition, and Morphology of Electrodeposited CoxFe1–x Alloys", J. Electrochem. Soc. 144, No. 9,3222–3226(1997).

Herreros et al., "Preparation of F3–Co–P Amorphous Alloys By Electrodeposition", J. Non–Crystalline Solids, 201, 102–109(1996).

Areos et al., "Direct and Pulse Current Electrodeposition of Ternary CoFeX, CoNiX and Ni FeX Thin Film Alloys", Electrochemical Soc. Proc., 95, No. 18, 562–569, publication date not given.

Liu et al., "Electrodeposition of soft, high moment Co–Fe–Ni Thin Films", J. Apl. Phys., 87, No. 9,5410–5412(2000).

* cited by examiner

*Primary Examiner*—Roy King
*Assistant Examiner*—William T. Leader
(74) *Attorney, Agent, or Firm*—Scully Scott Murphy & Presser; Lewis L. Nunnelley

(57) ABSTRACT

A cobalt-iron alloy film having saturation magnetization of at least about 2.30 Telsa. The film alloy includes about 55 wt % to about 75 wt. % iron and the remainder cobalt. The film is made by a process in which the film is electrodeposited from an aqueous medium which includes one or more ferrous salts, one or more cobaltous salts, a buffer having a pKa of about 6 to about 8, at least one carboxylic acid having a pKa of between about 3.5 and about 5.5, an aromatic sulfinic acid or its salt and optionally, a halide salt and/or a surfactant. The alloy film is useful as a write head in magnetic recording.

17 Claims, 6 Drawing Sheets

COFE ALLOY FILM AND PROCESS OF MAKING SAME

RELATED APPLICATIONS

This application is a divisional application of U.S. application Ser. No. 09/634,171, filed Aug. 9, 2000.

BACKGROUND OF THE DISCLOSURE

1. Field of the Invention

The present invention is directed to a CoFe soft magnetic thin film alloy having magnetic properties well suited for use in the fabrication of thin film magnetic recording heads and a process for making same. More specifically, the present invention is directed to a CoFe alloy thin film in which the iron constituent is present in a concentration of between about 55 wt. % and 75 wt. % iron and a process for making same.

The application of this high saturation magnetization. CoFe thin film also includes magnetic shields for magnetoresistive read heads, magnetic actuators which may require high moment low Hc materials, application in Micro-Electro Mechanical Systems (MEMS), soft magnetic underlay in magnetic perpendicular recording disk and other applications in electronics. All the above areas require thin electroplated magnetic films because cast materials cannot be used.

2. Background of the Prior Art

The ever expanding demand for greater storage density in magnetic recording systems has correspondingly led to increased demand for magnetic storage media with increased coercivity and higher a real storage density. In order to write to these higher coercivity media it is necessary to have write heads which will put out a higher magnetic flux. Write heads which put out a higher magnetic flux must be made of magnetic pole materials with a higher saturation magnetization.

At present, the highest moment alloy films commercially available are nickel-iron alloys having a saturation magnetization of about 1.75 Tesla. Higher moment alloys are known in the art. These higher moment alloy films are electrodeposited films of an alloy of cobalt-nickel-iron and cobalt-iron-copper having a saturation magnetic moment of 1.9 to 2.0 Tesla.

In spite of these advances in the development of write head-materials, there is a continuing need for the development of magnetic thin films having even higher magnetic moment values.

Although cobalt-iron (CoFe) alloys in the 55–75 wt. % Fe range are known to provide high saturation magnetization, such alloys have been formulated by casting. Obviously, the formation of a very thin film, suitable for use in write head applications, from a cast alloy is not obtainable. The fabrication of such a film by sputtering, vapor deposition and electroplating have been attempted. Sputtering does not produce a film having anisotropic characteristics, which is essential in write head applications vapor deposition results in course grained films which are also unsuitable in this application. Electrodeposition, however, represents a most promising method to form improved thin film CoFe alloy thin films for application as write heads.

Past attempts to produce high-iron CoFe alloy electrodeposited films have failed to generate films having satisfactory magnetic and mechanical properties. Typical electrodeposited CoFe films have high magnetic coercivity, poor or non-existent magnetic anisotropy, saturation magnetization (4 nMs) substantially lower than the theoretical 2.40–2.45 Tesla, and are so stressed that they cannot be plated to a useful thickness (which in write heads is in the 1–3 micron range) without delamination. This poor performance can be ascribed at least in part to the incorporation of oxygen into the electroplated CoFe film during deposition, a characteristic which does not occur when a CoFe alloy is cast. Thus, new thin film CoFe alloys and new processes for making such films which are substantially free of oxygen represents a well established need in the art.

CoFe-containing alloys, including films of such alloys, as well as processes for their manufacture, are known in the art. Examples of the most pertinent of such art are included hereinbelow.

U.S. Pat. No. 4,756,816 describes a process for the electrodeposition of a cobalt-iron alloy on a substrate. This process occurs in an aqueous electrolytic plating bath. The cobalt-iron alloy has an approximate cobalt to iron weight ratio of 90:10. The plating solution also has sodium saccharin, dodecyl sodium sulfate and wetting and buffering agents. The CoFe thin film that results from using the disclosed process has near zero magnetostriction, acceptable permeability for use as a magnetic head, a highly stabilized magnetic domain and approximately 2.0 Tesla saturation magnetization. Magnetic heads fabricated from such films are well suited for use with high coercivity media for high density magnetic recording.

U.S. Pat. No. 5,372,698 is directed to a process of forming a thin film magnetic read/write head having a thin film magnetic core and a substrate upon which a crystalline magnetic alloy of cobalt, iron and boron is electrodeposited. The cobalt-iron-boron core is 90% cobalt and has a saturation magnetization of 1.9 Tesla.

Japanese Patent Publication 6036929 sets forth a wet plating method for making a magnetic thin film. The method involves plating a cobalt-iron-tin alloy in which the tin constituent is present in a concentration of 8 to 25 wt. %.

Japanese Patent Publication 4-229607 discloses a magnetic thin film formed in an electroplating method in which the coating alloy is mainly cobalt but also includes iron in a concentration of 2 to 15 wt. % and sulfur in a concentration of 500 to 2,000 ppm. The sulfur constituent is provided by a sulfinic acid group or its salt, a sulfonic acid group or its salt, a sulfonimide group, a sulfonamide or a thiourea-based compound and mercaptodicarboxylic acid. However, the alloy composition disclosed in this Japanese patent refers to a high cobalt content alloy (85 wt. % to 98 wt %) and does not cover alloys containing lower Co concentration. In addition, although we have no indication of the value of the saturation magnetization, we can estimate its value being below 2.5 Telsa based on the general trend among high cobalt-content CoFe alloys.

Japanese Patent Publication 2-107,737 teaches an amorphous soft magnetic film which includes cobalt, iron, tin and phosphorus.

U.S. Pat. No. 2,654,703 describes the electrodeposition of bright nickel, cobalt, and alloys thereof from acid baths, using aryl (aromatic) sulfinic acids or salts thereof. The plating of cobalt-iron alloys is not claimed; in fact, sulfinates are said to retard the rate of codeposition of iron if ferrous salts are added to such baths, which, if true, would obviously be undesirable in the plating of high-iron cobalt alloys. No mention is made of any magnetic properties or uses of these alloys.

U.S. Pat. No. 5,587,026 concerns a ferromagnetic film which has high saturation magnetic flux density. The film is an alloy of cobalt, iron and a metal selected from the group consisting of tantalum, titanium, zirconium, hafnium, molybdenum and tungsten. The addition of a ternary element to the CoFe alloy system can achieve relatively high saturation magnetic flux density (4 nMs) between −1.5 to 1.9 Tesla and after high temperature annealing a coercivity lower than 1.88 Oersteds. The cobalt content of the ferromagnetic film is 73 at % to 94 at %.

U.S. Pat. No. 4,306,908 is directed to a ferromagnetic amorphous alloy having the formula $(Co_xNi_yFe_z)_aM_bG_c$, where M is Cr, Mo and/or W; G is Zr, Hf and/or Ti; $x=1-y-z$; $0 \leqq y \leqq 0.2$; $0 \leqq z \leqq 0.7$; $a=1-b-c$; $0 \leqq b \leqq 0.5$; and $0.05 \leqq c \leqq 0.2$.

U.S. Pat. No. 4,933,026 involves a soft magnetic cobalt-iron alloy which includes 0.15% to 0.5% Ta, Nb or mixtures thereof. The cobalt constituent of the alloy is present in a concentration of between about 33% and 55%. This alloy is stated to be operable at temperatures as high as between 960° and 980° C., up to 100° C. above the highest possible operable temperature of earlier approximately equal weight cobalt-iron alloys. The cast alloy of this disclosure is fabricated by vacuum melting and hot rolling a cast ingot to 2.5 mm thickness, reheating the strip to above the order-disorder temperature, i.e. about 800° C., and quenching in a brine solution below 0° C. However, the use of the very high temperatures (above 150° C.) required in the production of CoFe cast alloy is not compatible with the fabrication of magnetic recording thin film heads which makes this CoFe alloy unusable for such an application more generally, the casting process of this patent is not suitable for the preparation of thin film structures.

U.S. Pat. No. 4,925,502 provides a soft cobalt-iron alloy which consists essentially of 35% to 60% by weight Co; 0.03% to 2% by weight Al and the remainder iron. This alloy is formed by compacting and sintering cobalt, iron and aluminum or iron-aluminum powders. The sintering process used in the '502 patent implies the application of very high temperatures (−1400 C.) and is consequently not compatible with the fabrication of magnetic recording thin film heads and the like.

An article by L. H. Chen et al. entitled "Soft-Magnetic Properties of Fe—Co—B Thin Films for Ultra-High-Frequency Applications" in J. Appl. Physics, Vol. 87, Number 9, pp 5858–5860 (May 2000) describes an amorphous CoFeB thin film sputter deposited at a composition of 67 at % iron, 18 at % cobalt and 15 at % boron. Although this thin film exhibits a very low coercivity of about 0.3 Oersted, the saturation magnetization is very low (4 nMs −1.75 Tesla). Moreover, by conventional RF magnetron sputtering technique, a perpendicular magnetic anisotropy tends to occur easily, which would be strongly detrimental to the performance of magnetic recording thin film heads.

An article by S. S. Abd El Rehim et al., "Electroplating of CoFe Alloys from Aqueous Acetate Bath" in Trans. IMF, 2000, 78 (1), pp 41–42 shows CoFe thin films with a composition ranging from about 43% up to about 66% iron (no indication if they are weight or atomic percentages). The alloy composition disclosed in this article has microcracks and is consequently not suitable for the fabrication of magnetic recording thin film heads and the like. Moreover, the authors do not give any indication concerning the magnetic properties of these CoFe alloys.

The full range of CoFe compositions has been investigated by E. M. Kakuno et al. in "Structure, Composition, and Morphology of Electrodeposited $Co_xFe_{1-x}$ Alloys" in J. Electrochem. Soc., Vol. 144, No. 9, September 1997, pp. 3222–3226 from an additive-free sulfate-based plating bath. The $Co_xFe_{1-x}$ thin films with an alloy composition varying from x=1 to 0 show heterogeneous morphology and composition and are then not suitable for the fabrication of magnetic recording thin film heads and the like. No indication of the magnetic properties of these alloys is given in this article.

In U.S. Pat. No. 4,208,254, the patentees disclose a method of electrodepositing a CoFe alloy having a composition of 7.5–55 wt. % iron the remaining being cobalt, from a fluoride-containing bath. No saturation magnetization value is given in this patent disclosure.

Soft magnetic amorphous CoFeP alloys have been reported in the literature. For example, J. Herretos et al., "Preparation of Fe—Co—P Amorphous Alloys by Electrodeposition" in J. of Non-Crystalline Solids, 201 (1996) pp. 102–109 have electrodeposited a $Fe_{56}Co_{30}P_{14}$ alloy with a coercivity of about 2 to 5 Oersteds. There is no indication of saturation magnetization. Although amorphous CoFeP alloys have been shown to exhibit excellent soft magnetic properties, they generally have a lower saturation magnetization due to the addition of glass forming agent in relatively high concentrations.

Another type of amorphous CoFe alloy is obtained by the addition of boron as described in U.S. Pat. No. 5,372,698 where the patentees disclose an electrodeposited CoFeB with an iron content between about 7 wt. % and about 12 wt. %, a boron content between about 0.1 wt. % and about 2.0 wt. %, the remaining being cobalt and having a saturation magnetization (4 πNs) of about 1.9 Tesla and a coercivity of about 1.0 Oersted. Despite good soft magnetic properties, the cobalt content (about 90 wt. %) of this alloy is between 25 wt. % and 45 wt. %. Moreover, the alloy of this patent has a low magnetization.

An electrodeposited CoFe alloy containing vanadium is presented by Arcos et al., "Direct and Pulse Current Electrodeposition of Ternary CoFeX, CONiX and NiFeX Thin Film Alloys" in Proc. of the $4^{th}$ Int. Symp. on Mag. Mat. Proc. and Dev., L. T. Romankiw and D. A. Herman, Jr. Eds, 95-18, (1995), pp. 563–569. CoFeV electrodeposites having a magnetic moment of about 2.0 Tesla are presented in this study. However, no clear indication of the alloy composition and no indication of the coercivity is provided. Furthermore, the saturation magnetization-of about 2 Tesla is too low for this material to be used in the fabrication of advanced magnetic recording thin film heads.

The addition of copper to the electrodeposited CoFe alloy is disclosed by Andricacos et al. in U.S. Pat. No. 5,582,927 where a $Co_xFe_yCu_z$ alloy with a composition in the range of about 65 wt. % to 92 wt. % cobalt, about 6 wt. % to 15 wt % iron and about 2 wt % to 20 wt. % Cu has been electrodeposited. This alloy has a high saturation magnetization (4 πMs) in the range of 1.6 Tesla to 2.4 Tesla and a coercivity of less than 1 Oersted. However, these excellent soft magnetic properties require a very low iron content CoFe alloy, i.e., less than 15 wt %.

In U.S. Pat. Nos. 4,014,759 and 4,053,373 an α-hydroxy sulfone compound, which is the reaction product of an aromatic sulfinate and an aldehyde or dialdehyde, is used in iron-containing baths to improve plating of 15 wt. % to 70 wt. % Fe-containing alloys of nickel or cobalt or nickel and cobalt.

Finally, Liu, et al., Journal of Applied Physics, Vol. 87, no. 9, 5410–5412 (2000) describes the electrodeposition of cobalt-iron-nickel alloy thin films for magnetic recording heads. This deposition occurs in the absence of sulfur-containing additives. Although the coercivity of these films was about 1 Oe, the saturation magnetization was only 2.0 Tesla.

SUMMARY OF THE INVENTION

A new alloy film and process for making that soft magnetic thin film alloy has now been developed which provides a saturation magnetization (4 πMs) above the maximum saturation magnetization (4 πMs) obtained by commercially available soft magnetic thin film alloys. The newly developed soft magnetic thin film is particularly suitable for use as a write head in magnetic recording.

The soft magnetic thin film alloy of the present invention is a CoFe alloy fabricated in an electroplating process from an aqueous plating bath to produce a smooth, bright surfaced film indicative of the substantial absence of oxygen and iron oxide. A paddle cell with continuous filtration is used for the electroplating process. A magnetic field of 700–800 Gauss can be used during plating to magnetically orient the electroplated CoFe alloy film. The resulting soft magnetic thin film alloy has relatively low stress and can be plated to thickness up to 2 microns.

In accordance with the present invention a cobalt-iron film comprising between about 55% and about 75% iron and the remainder cobalt, said percentages being by weight based on the total weight of the alloy, is provided. The film is further characterized by a maximum saturation magnetization (4 πMs) of at least about 2.30 Tesla.

In further accordance with the present invention a process of making the cobalt-iron alloy film is disclosed. In that process the cobalt-iron alloy film is electrodeposited from an aqueous medium which includes one or more ferrous salts; one or more cobaltous salts; a buffer having a pKa of about 6 to about 8 which does not co-deposit into the plated CoFe thin film alloy; one or more mono- or polycarboxylic acids having pKa(s) in the range of between about 3.5 and about 5.5; an aromatic sulfinic acid or a salt thereof; optionally, a chloride salt; and optionally, a surfactant.

BRIEF DESCRIPTION OF THE DRAWINGS

The present invention may be better understood by reference to the drawings of which.

DETAILED DESCRIPTION

Figure 1:
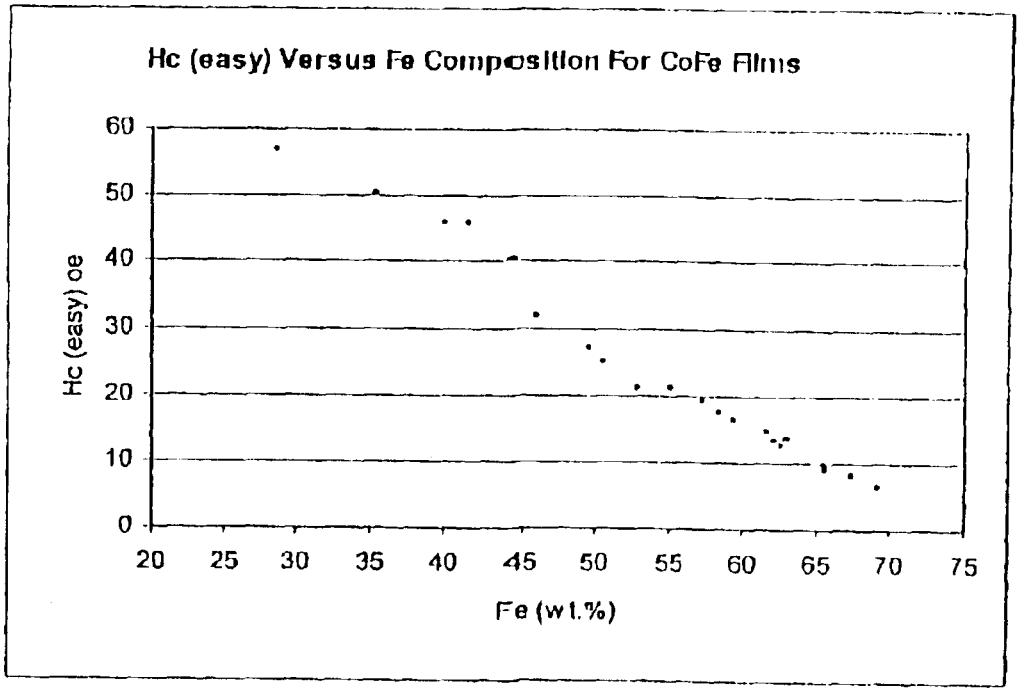
FIG. 1 is a graph of easy axis coercivity ($H_c$) as a function of weight percent iron of a CoFe soft magnetic thin film alloy.

The cobalt-iron (CoFe) alloy film of the present invention, characterized by a bright, smooth finish, is substantially free of oxygen and iron oxide. The CoFe film is preferably a thin film having a thickness up to 2 microns.

The CoFe soft magnetic thin film alloy comprises about 55% and about 75% iron and the remainder, between about 25% and about 45%, cobalt, the percentages being by weight, based on the total weight of the alloy film. Preferably, the constituency of the CoFe alloy film is about 60% to about 66% iron and the remainder, between about 34% and about 40%, cobalt. More preferably, the CoFe alloy film is present in a concentration of between about 62% and about 65% iron and the remainder, between about 35% and about 38%, cobalt.

The CoFe alloy film is further defined by a maximum saturation magnetization, also denoted by the scientific notation, 4 $\pi M_s$, of between about 2.3 and about 2.5 Telsa. Preferably, the 4 $\pi M_s$ of the CoFe alloy film is in the range of between about 2.32 and about 2.50 Tesla. More preferably, the maximum saturation magnetization of the CoFe alloy is in the range of between about 2.38 and about 2.53 Telsa.

The CoFe alloy film is anisotropic, as defined by an easy axis coercivity ($H_{ce}$) of no more than 22 Oersted (Oe), which drops to no more than about 12 Oe upon annealing; a hard axis coercivity ($H_e$) of no more than about 17 Oe, which drops to no more than about 9 Oe upon annealing; and a magnetic anistrophy ($H_k$) of no more than about 30 Oe, which is substantially unchanged upon annealing.

Preferably, the anisotropic properties of the CoFe alloy film are manifested by an easy axis coercivity of no more than about 17 Oe, which drops to no more than about 8 Oe upon annealing; a hard axis coercivity of no more than about 7 Oe, which drops to about 3.5 Oe upon annealing; and a magnetic anisotropy of no more than about 24 Oe which is substantially unchanged upon annealing.

More preferably, the CoFe alloy film has the following anisotropic properties: an easy axis coercivity of no more than about 15 Oe, which drops to no more than about 6 Oe upon annealing; a hard axis coercivity of no more than about 5 Oe, which drops to no more than about 2.5 Oe upon annealing; and a magnetic anisotropy of no more than about 20.5 Oe, which is substantially unchanged upon annealing.

The CoFe alloy film is further characterized by a specific resistivity in the range of between about 17 and about 65 ΞΩ-cm. Preferably, the CoFe alloy film has a specific resistivity of between about 24 and about 42 μΩ-cm. Most preferably, the specific resistivity is in the range of between about 30 and about 40 μΩ-cm.

The CoFe alloy film is characterized by an internal mechanical tensile stress of between about 250 and about 800 MegaPascals.(MPa). Preferably, the film is characterized by a stress of between about 470 and about 700 MPa. More preferably, the CoFe alloy film is characterized by a stress of between 600 and about 630 MPa.

The CoFe alloy film of the present invention is prepared by a process in which the film is electroplated from an aqueous chemical plating bath. The plating bath is characterized by a pH of about 2.5 to about 3.5. The minimum pH is limited by hydrogen evolution and reduced current efficiency, and the maximum pH by the propensity of ferrous ions to oxidize and precipitate as ferric compounds. Preferably, the pH is in the range of between about 2.8 and about 3.2.

The plating bath is an aqueous solution of one or more ferrous salts, of which the anion is preferably sulfate; one or more cobaltous salts of which the anion is preferably sulfate; a buffer having a pKa of about 6 to about 8 which does not co-deposit into the plated CoFe thin film alloy, e.g. boric acid; one or more mono- or polycarboxylic acids having pKa(s) in the range of between about 3.5 and about 5.5, e.g. acetic acid; an aromatic sulfinic acid or a salt thereof; optionally, a halide salt; and, optionally, a surfactant. Preferably, the pH of the plating bath is between about 2.8 and about 3.2. The plating solution is preferably recirculated continuously through a fine filter (0.2–0.5 micron) in order to avoid precipitation of ferric compounds.

The electroplating operation is conducted at an average cathodic current density of between about 3 milliamperes/square centimeters ($mA/cm^2$) and about 40 $mA/cm^2$. Preferably, the average cathodic current density is in the range of between about 5 $mA/cm^2$ and about 30 $mA/cm^2$. More preferably, the plating operation is conducted at an average cathodic current density of between about 10 $mA/cm^2$ and about 20 $mA/cm^2$. Various current versus time programs may be used in the plating, including, but not limited to, direct current, pulsed current, cathodic based sinusoidal current and pulsed reversed current. The electroplating may also be accomplished on various thin film electrically conductive substrates which have been properly prepared for plating (in a manner known by those skilled in the art). These substrates may include, but not are not limited to, nickel-iron alloys, nickel-cobalt alloys, iron-cobalt alloys, cobalt-nickel-iron alloys, iron-nitrogen alloys, iron-aluminum-nitrogen alloys, rhodium, ruthenium, platinum, gold, copper and palladium. An iron or a cobalt anode can be used in the plating equipment. Dimensionally stable anodes of platinized titanium, platinum, graphite or carbon can also be used. A cobalt anode is preferred as it undergoes anodic dissolution easily and does not cause substantial oxidation of the ferrous ion in solution.

Turning to the specific constituents of the plating bath, the mono or polycarboxylic acid is preferably acetic acid. Other monocarboxylic or polycarboxylic acids which may also be used include succinic acid, glutaric acid and methylsuccinic acid. Sugar alcohols, such as mannitol or sorbitol, may also be used as part of the buffer mixture.

The mono or polycarboxylic acid is provided in a concentration in the range of between about 0.01 Molarity (M) and 0.4M. Preferably, the carboxylic acid is present in a concentration of between about 0.02 M and about 0.33 M. More preferably, the carboxylic acid concentration ranges between about 0.02 M and 0.25 M.

The buffer, as suggested above, is preferably boric acid, which has been shown to have a pKa of 6 to 8 in the electroplating bath described here. Other buffers, which may also be used instead of boric acid, include alkyl-substituted pyridines such as picolines and lutidines. In particular, such picolines and lutidines as 2-picoline and 2,6-lutidine are preferred. As stated above, buffers other than those recited above, which have a pKa of 6 to 8 and do not co-deposit into the plated CoFe thin film alloy, can be employed.

This buffer is present in an amount in the range of between about 0.08 Molarity (M) and about 0.65 M; preferably, between about 0.16 M and about 0.49 M; and more preferably, between about 0.32 M and about 0.44 M.

The halide salt employed in the plating bath is preferably a chloride or a bromide salt in which the cation is an alkali metal, an alkaline earth metal, cobalt or iron. Other inorganic halides may be used provided that the cation produced during salvation does not plate into the thin film CoFe alloy. In addition, organic halides may be used provided they do not adversely affect the plating rate or plated film quality. Of these, alkali metal halides are preferred. Of the alkali metal halides, sodium chloride is most preferred.

The halide salt constituent of the plating bath is present in a concentration of about 0.0017 Molarity (M) to about 0.0342 M; preferably, between about 0.0051 M and about 0.0171 M; and more preferably, between about 0.0068 M and about 0.0120 M.

The inorganic cobalt salt of the plating bath is any soluble salt of cobalt. Among preferred soluble cobalt salts are hydrates. As indicated above, it is preferred that the cobalt salt be a sulfate although a chloride or a bromide salt is acceptable.

The ferrous salt of the plating bath, like the cobalt salt, is any soluble ferrous salt. Also, like the cobalt salt, a preferred class of soluble ferrous salts are hydrates. Indeed, in accord with the cobalt salts, sulfates are particularly preferred although a chloride or a bromide may be employed.

As those skilled in the art are aware, the concentration of the cobalt salt in the electroplating bath, relative to the concentration of the iron salt, dictates the concentration of the electroplated CoFe alloy film. Thus, this concentration varies depending upon the desired constituency of the CoFe film. Preferably, though, the range of iron metal ion (2+ valence) in the bath is in the range of about 0.10 Molarity (M) to about 1.50 M.

The aromatic sulfinic compound of the electroplating bath is preferably an aromatic sulfinic acid or a salt thereof. The aromatic sulfinic salt form is preferable because aromatic sulfinic salts tend to be more soluble than aromatic sulfinic acids. The cation of the salt can be any metal ion that is inert under plating conditions, e.g. sodium or potassium. The acid can be any sulfinic derivative of benzene or naphthalene, with optional additional substituents (on the aromatic ring) that are inert under the plating conditions. Thus, such substituents as alkyl, chloro, and alkoxy may be present.

A preferred aromatic sulfinic compound is benzenesulfinic acid. More preferably, a sodium salt of a benzenesulfinic hydrate salt, the sodium dihydrate salt of benzenesulfinic acid, sodium benzenesulfinate dihydrate, is employed. Other aromatic sulfinic acids or salts that can be employed include sodium toluenesulfinate, sodium p-chlorobenzenesulfinate and the like.

The benzenesulfinate salt is present in the plating bath in a concentration of about 0.000061 Molarity (M) to about 0.001218 M; preferably, between about 0.000091 M to about 0.000914 M; and more preferably, between about 0.000122 M to about 0.000610 M. The sulfinate additive is slowly consumed both by plating and by air oxidation; therefore, periodic replenishment is needed.

It will be obvious to one skilled in the art that surfactants are useful for proper wetting of the substrate to be plated. They are also helpful in preventing gas bubbles from adhering to the surface of the substrate. However, the presence of a surfactant in the plating bath is not an essential part of this invention. If the use of a surfactant is desired, the surfactant provided in the plating bath may be Fluorad FC-95 or Fluorad FC-98, both being anionic surfactant products of the 3M Company. Other surfactants such as, but not limited to, sodium lauryl sulfate can also be used. The surfactant constituent, if present, is used in a concentration of about 0.01–0.03 g/l for the Fluorad type surfactants and about 0.2–0.5 g/l for sodium lauryl sulfate.

The electroplating in this invention is performed at a temperature range between 10° C. and 46° C. The best film properties of CoFe are achieved between 10° and 25° C.

The following examples are given to illustrate the scope and spirit of the present invention. Because these examples are given for illustrative purposes only, the present invention should not be interpreted as being limited thereto.

EXAMPLES

A series of examples were prepared wherein the CoFe alloy films were electroplated from a plating bath. The plating bath was an aqueous solution, having a pH of 3, of the following constituents whose concentrations are provided below, except for the cobalt and sulfate salt constituents whose concentrations varied to provide a range of concentration of the resultant CoFe alloy films. The examples included CoFe alloy films within and outside the present invention insofar as the iron concentration of the CoFe alloy film ranged between 35 wt % and 70 wt %. In all cases, the plating occurred at a current density of 10 to 20 mA/cm$^2$. During plating the temperature was maintained at 21.3° C. accompanied by a paddle speed of 1 Hz.

Figure 2:
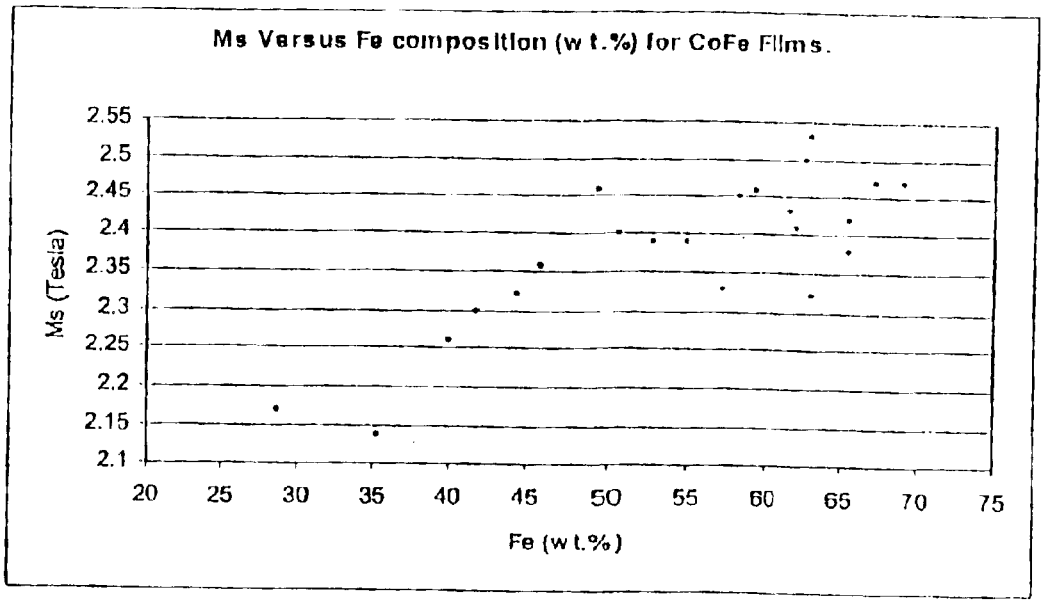
FIG. 2 is a graph of saturation magnetization (4 $\pi M_s$) as a function of weight percent iron of a CoFe soft magnetic thin film alloy.
Figure 3:
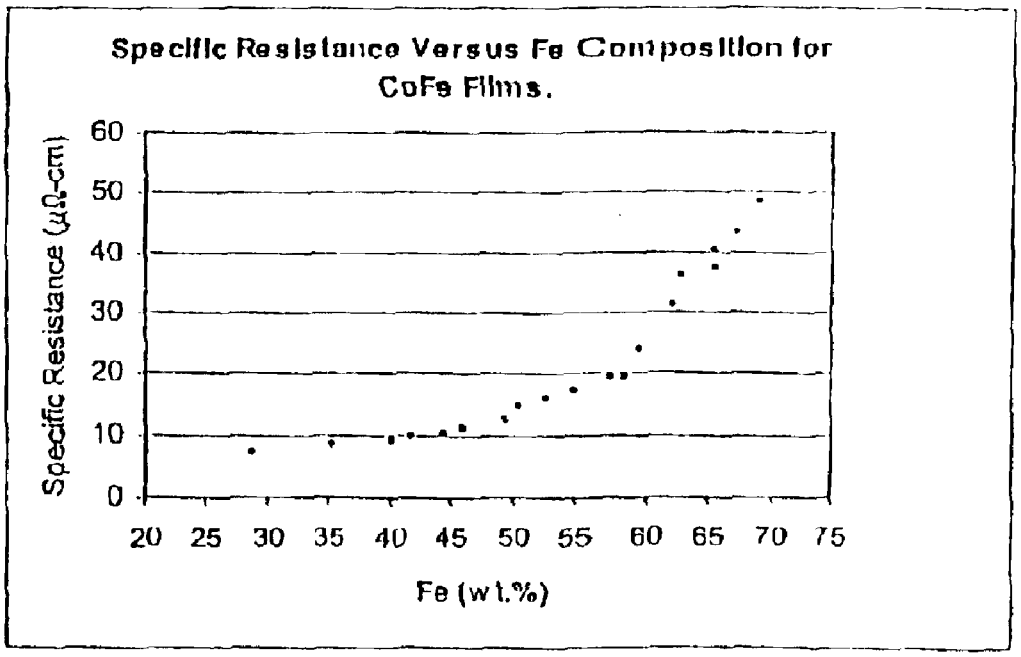
FIG. 3 is a graph of film resistivity (in μΩ-cm) as a function of weight percent iron of a CoFe soft magnetic film alloy.
Figure 4:
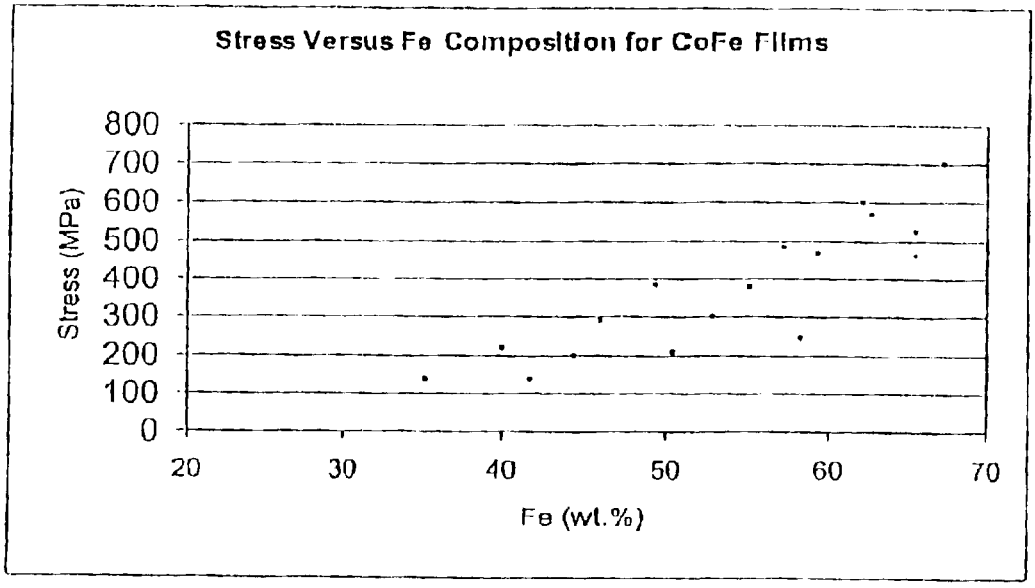
FIG. 4 is a graph of film stress as a function of weight percent iron of a CoFe soft magnetic thin film alloy.
Figure 5:
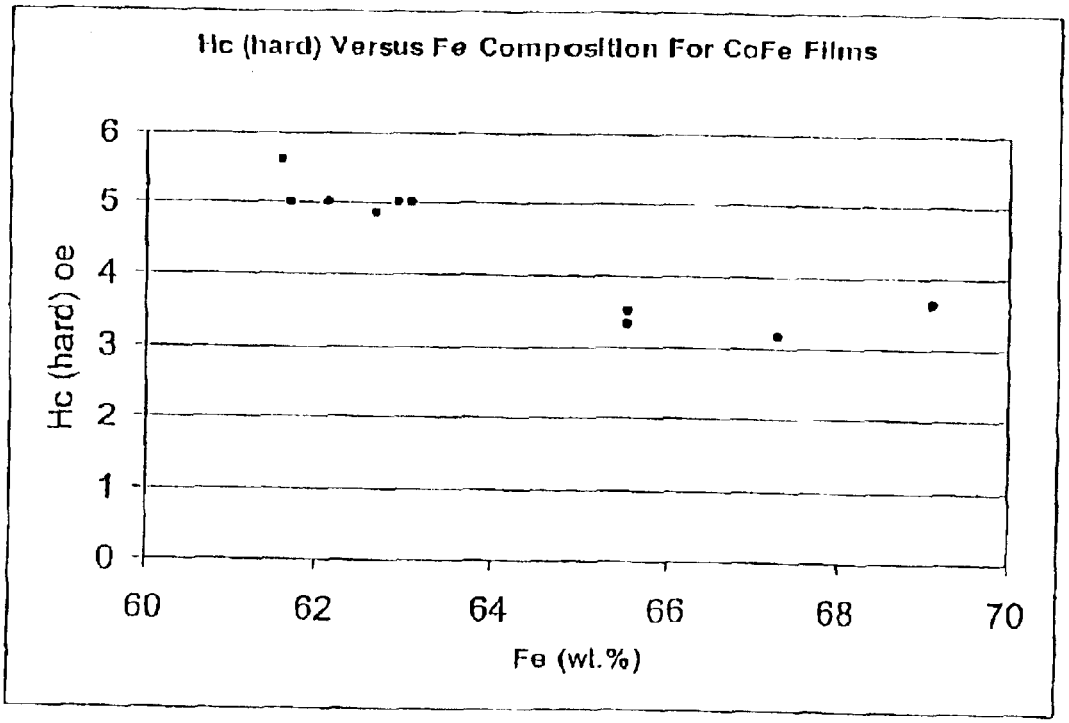
FIG. 5 is a graph of hard axis coercivity ($H_c$) as a function of weight percent iron of a CoFe soft magnetic thin film alloy.
Figure 6:
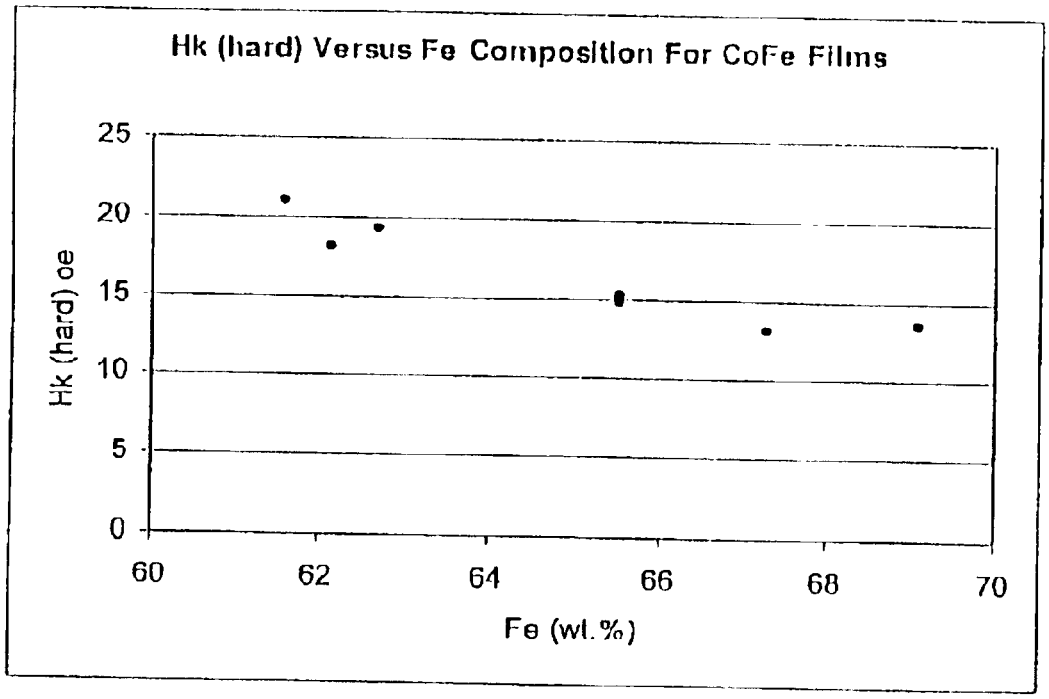
FIG. 6 is a graph of magnetic anisotropy ($H_k$) as a function of weight percent iron of a CoFe soft magnetic thin film alloy.

These examples, within and outside the scope of the present invention, produced cobalt-iron alloy films. The films including their physical properties are summarized in the Table and are pictorially depicted in FIGS. 1–6.

For illustrative purposes four examples of plating solutions, including the resultant alloy films, are set forth below. Since these examples are provided for illustrative purposes only, the invention should not be deemed limited thereto.

Example 1

| Constituent | Concentration, g/l |
|---|---|
| Acetic acid | 3 |
| Boric acid | 25 |
| $CoSO_4 \cdot 7H_2O$ | 17.54 |
| $FeSO_4 \cdot 7H_2O$ | 62.95 |
| Sodium benzene sulfinate | 0.09 |
| FC-95 surfactant | 0.01 |

This particular bath composition, having a molar ratio of Fe/(Fe+Co) of 0.784 yields of a film containing 72.37 wt % Fe and 27.63 wt % Co. This film, denoted in the Table as Alloy Film No. 26, is within the scope of the present invention.

Example 2

| Constituent | Concentration, g/l |
|---|---|
| Acetic acid | 12 |
| Boric acid | 25 |
| $CoSO_4 \cdot 7H_2O$ | 53 |
| $FeSO_4 \cdot 7H_2O$ | 122 |
| Sodium beuzene sulfinate | 0.09 |
| FC-95 surfactant | 0.01 |
| NaCl | 0.5 |

This particular bath composition, having a molar ratio of Fe/(Fe+Co) of 0.699, yields a film denoted in the Table as Alloy Film No. 16, within the scope of the present invention.

Example 3

| Constituent | Concentration, g/l |
|---|---|
| Acetic acid | 12 |
| Boric acid | 25 |
| $CoSO_4 \cdot 7H_2O$ | 53 |
| $FeSO_4 \cdot 7H_2O$ | 102 |
| Sodium benzene sulfinate | 0.04 |
| FC-95 surfactant | 0.01 |
| NaCl | 0.5 |

The film produced by the above plating bath composition is set forth in the Table as Alloy Film No. 10. The film of this example was within the scope of the present invention.

Example 4

| Constituent | Concentration, g/l |
|---|---|
| Acetic acid | 12 |
| Boric acid | 25 |
| $CoSO_4 \cdot 7H_2O$ | 53 |
| $FeSO_4 \cdot 7H_2O$ | 42 |
| Sodium benzene sulfinate | 0.02 |
| FC-95 surfactant | 0.01 |
| NaCl | 0.5 |

The product of this plating bath composition produced Alloy Film No. 1, outside the scope of the present invention.

TABLE

| Alloy Film No. | Fe wt. % | Co wt. % | Hc (easy) (Oe) | Stress (Mpa) | 4 nMs (Tesla) | Specific Resistance $\mu\Omega$-cm | Hk (hard) (Oe) | Hc (hard) (Oe) |
|---|---|---|---|---|---|---|---|---|
| 1 | 35.22 | 64.78 | 50.32 | 139.3 | 2.14 | 8.76 | 124.5 | 48.78 |
| 2 | 40 | 60 | 46.02 | 223.3 | 2.26 | 8.89 | 118.9 | 47.69 |
| 3 | 41.7 | 58.3 | 46.05 | 136.1 | 2.3 | 9.71 | 111.2 | 45.53 |
| 4 | 44.37 | 55.63 | 40.38 | 198.9 | 2.32 | 10.31 | 103 | 42.11 |
| 5 | 45.88 | 54.12 | 31.8 | 289.7 | 2.36 | 11.27 | 91.9 | 37.39 |
| 6 | 49.39 | 50.61 | 26.96 | 383 | 2.46 | 12.55 | 73.97 | 28.02 |
| 7 | 50.47 | 49.53 | 25.17 | 211.1 | 2.4 | 14.37 | 45.88 | 24.2 |
| 8 | 52.74 | 47.26 | 21.29 | 299 | 2.39 | 15.87 | 33.41 | 16.92 |

TABLE-continued

| Alloy Film No. | Fe wt. % | Co wt. % | Hc (easy) (Oe) | Stress (Mpa) | 4 nMs (Tesla) | Specific Resistance μΩ-cm | Hk (hard) (Oe) | Hc (hard) (Oe) |
|---|---|---|---|---|---|---|---|---|
| 9 | 54.98 | 45.02 | 21.29 | 380 | 2.39 | 17.35 | | |
| 10 | 57.22 | 42.78 | 19.2 | 484.8 | 2.33 | 19.29 | 26.49 | 10.78 |
| 11 | 58.34 | 41.66 | 17.38 | 247.7 | 2.45 | 19.3 | 26.98 | 8.049 |
| 12 | 59.34 | 40.66 | 16.29 | 470.9 | 2.46 | 24.17 | | 5 |
| 13 | 60.87 | 39.13 | 17.37 | | 2.49 | 21.37 | 20.21 | 6.863 |
| 14 | 61.58 | 38.42 | 14.94 | | 2.47 | 23.28 | 21.13 | 5.609 |
| 15 | 61.69 | 38.31 | 14.66 | | 2.43 | | | 5 |
| 16 | 62.13 | 37.87 | 13.28 | 599 | 2.41 | 31.48 | 18.17 | 5.009 |
| 17 | 62.68 | 37.32 | 12.66 | 569.9 | 2.5 | 35.82 | 19.22 | 4.857 |
| 18 | 62.96 | 37.04 | 13.87 | | 2.53 | | | 5 |
| 19 | 63.11 | 36.89 | 13.84 | | 2.32 | | | 5 |
| 20 | 65.52 | 34.48 | 8.855 | 527.4 | 2.38 | 40.33 | 15.19 | 3.314 |
| 21 | 65.52 | 34.48 | 9.463 | 460.9 | 2.42 | 37.34 | 14.87 | 3.488 |
| 22 | 67.29 | 32.71 | 8.231 | 697.9 | 2.47 | 43.14 | 13.19 | 3.169 |
| 23 | 69.09 | 30.91 | 6.536 | | 2.47 | 48.45 | 13.51 | 3.618 |
| 24 | 69.96 | 30.04 | 7.247 | | 2.37 | | 18.59 | 2.208 |
| 25 | 72.2 | 27.8 | 6.878 | | 2.331 | | 14.34 | 1.809 |
| 26 | 72.37 | 27.63 | 6.491 | | 2.34 | | 15.7 | 1.98 |
| 27 | 74.3 | 25.7 | 6.863 | | 2.333 | | 13.32 | 1.66 |

The above embodiments and examples are given to illustrate the scope and spirit of the present invention. These embodiments and examples will make apparent, to those skilled in the art, other embodiments and examples. These other embodiments and examples are within the contemplation of the present invention. Therefore, the present invention should be limited only by the appended claims.

What is claimed is:

1. A process of making a cobalt-iron alloy film which comprises electrodepositing an alloy film from an aqueous medium which includes one or more ferrous salts, one or more cobaltous salts, an acid which is at least one mono- or polycarboxylic acid having pKa in the range of between about 3.5 and about 5.5, a buffer which is at least one buffer having a pKa of about 6 to 8 which does not co-deposit into said alloy film and an aromatic sulfinic acid or a salt thereof.

2. A process in accordance with claim 1 wherein said ferrous salt is a ferrous sulfate salt and said cobalt salt is a cobalt sulfate salt.

3. A process in accordance with claim 2 wherein said ferrous sulfate and said cobalt sulfate salts are hydrates.

4. A process in accordance with claim 1 wherein said acid is acetic acid, succinic acid, glutaric acid, methylsuccinic acid, mannitol or sorbitol.

5. A process in accordance with claim 4 wherein said acid is acetic acid.

6. A process in accordance with claim 1 wherein said buffer is boric acid or an alkyl-substituted pyridine.

7. A process in accordance with claim 6 wherein said buffer is boric acid, 2-picoline or 2,6-lutidine.

8. A process in accordance with claim 1 wherein said aromatic sulfinic acid or salt thereof is a benzenesulfinate salt.

9. A process in accordance with claim 8 wherein said benzenesulfinic salt is a sodium salt of a benzenesulfinate hydrate salt.

10. A process in accordance with claim 1 wherein said aqueous medium includes a surfactant.

11. A process in accordance with claim 1 wherein said aqueous medium includes a halide salt.

12. A process in accordance with claim 11 wherein said halide salt is sodium chloride.

13. A process in accordance with claim 1 wherein said alloy film is electrodeposited upon an electrically conductive substrate from a wet chemical medium.

14. A process in accordance with claim 13 wherein said electrically conductive substrate is a thin film of a nickel-iron alloy, a nickel-cobalt alloy, an iron-cobalt alloy, a cobalt-nickel-iron alloy, an iron-nitrogen alloy, an iron aluminum-boron alloy, rhodium, ruthenium, platinum, gold, copper or palladium.

15. A process in accordance with claim 13 where said wet chemical medium includes acetic acid, boric acid, a cobalt sulfate salt, an iron sulfate salt and an alkali metal benzenesulfinate wherein said cobalt salt and iron salt are present such that the weight ratio of iron to cobalt, based on the total iron and cobalt weight in said chemical medium, is at least about 50%.

16. A process in accordance with claim 1 wherein said electroplating occurs at an average cathodic current density in the range of between about 5 and about 30 milliamperes per square centimeter and wherein said aqueous medium has a pH in the range of about 2.5 to about 3.5.

17. A process in accordance with claim 16 wherein said electroplating occurs using direct current, pulsed current, cathodically biased sinusoidal current or pulsed reversed current.

* * * * *

UNITED STATES PATENT AND TRADEMARK OFFICE

CERTIFICATE OF CORRECTION

PATENT NO. : 6,855,240 B2
DATED : February 15, 2005
INVENTOR(S) : Cooper et al.

It is certified that error appears in the above-identified patent and that said Letters Patent is hereby corrected as shown below:

Column 1,
Line 19, "magnetization. CoFe" should read -- magnetization CoFe --
Line 46, "write head-materials," should read -- write head materials, --

Column 4,
Line 30, "(4πNs)" should read -- 4πMs) --

Column 6,
Line 43, "ΞΩ-cm" should read -- μΩ-cm --
Line 49, "MegaPascals. (Mpa)" should read -- MegaPascals (MPa). --

Column 9,
Line 46, "beuzene" should read -- benzene --

Column 10,
Line 53, Table "4nMs" should read -- 4πMs --

Column 11,
Line 3, Table-continued "4nMs" should read -- 4πMs --

Signed and Sealed this

Thirty-first Day of May, 2005

JON W. DUDAS
*Director of the United States Patent and Trademark Office*